US008869841B2

(12) United States Patent
He

(10) Patent No.: US 8,869,841 B2
(45) Date of Patent: Oct. 28, 2014

(54) FABRIC STRAPS WITH TUBULAR STRUCTURE CONTAINING FREE-FLOATING YARNS AND VARIED WIDTH

(71) Applicant: New Horizon Elastic Fabric Co., Ltd, Dongguan (CN)

(72) Inventor: Mike He, Guangdong (CN)

(73) Assignee: New Horizon Elastic Fabric Co., Ltd, Dongguan, Guangdong (CN)

( * ) Notice: Subject to any disclaimer, the term of this patent is extended or adjusted under 35 U.S.C. 154(b) by 0 days.

(21) Appl. No.: 13/656,765

(22) Filed: Oct. 22, 2012

(65) Prior Publication Data

US 2014/0110015 A1 Apr. 24, 2014

(51) Int. Cl.

| | |
|---|---|
| ***D03D 3/02*** | (2006.01) |
| ***D03D 17/00*** | (2006.01) |
| ***D03D 15/08*** | (2006.01) |
| *D03D 25/00* | (2006.01) |

(52) U.S. Cl.

CPC ..... *D03D 15/08* (2013.01); *D03D 17/00* (2013.01); *D03D 3/02* (2013.01)

USPC ..... 139/422; 139/421; 139/420 R; 139/387 R

(58) Field of Classification Search

CPC ..... D03D 3/02; D03D 11/02; D03D 15/00; D03D 11/00; D03D 15/08; D03D 13/00; D03D 25/005; D03D 13/004; D03D 1/00; D03D 3/005; D03D 1/0094; D03D 23/00; D03D 3/00; D03D 9/00; D03D 13/008; D03D 15/06; D03D 27/00; D03D 7/00; D03D 17/00; D03D 25/00; D10B 2401/061; D10B 2401/046; D10B 2403/023; D10B 2403/0333; B32B 27/02; B32B 5/10; B32B 5/12; B32B 1/08; B32B 2250/20; D04B 21/20; D04B 1/18; D04B 1/225; D04B 21/18; D04B 21/205; D04B 21/207; A41D 2500/10; A41D 2500/20; A41D 27/00; A41D 31/0038; D04H 3/07; A41C 3/12

USPC ..... 139/384 R, 387 R, 408, 411, 420 R, 421, 139/422, 423

See application file for complete search history.

(56) References Cited

U.S. PATENT DOCUMENTS

| | | | | | |
|---|---|---|---|---|---|
| 1,473,427 | A | * | 11/1923 | Handley | 139/387 R |
| 1,670,366 | A | * | 5/1928 | Laurain | 139/423 |
| 2,092,287 | A | * | 9/1937 | Moore | 139/421 |
| 2,136,742 | A | * | 11/1938 | Herbener | 450/116 |
| 2,633,574 | A | * | 4/1953 | Dolan | 450/131 |
| 2,804,099 | A | * | 8/1957 | Sherman | 139/423 |
| 3,376,904 | A | * | 4/1968 | Bellmore | 139/423 |
| 3,653,075 | A | * | 4/1972 | Gluckin et al. | 2/338 |
| 3,858,622 | A | * | 1/1975 | Campbell et al. | 139/421 |

(Continued)

*Primary Examiner* — Bobby Muromoto, Jr.

(74) *Attorney, Agent, or Firm* — George G. Wang; Bei & Ocean

(57) ABSTRACT

Fabric strap having at least two different segments. The first segment is wider and less elastic, providing a comfortable contacting area to the skin and the other segment is narrower and more elastic which is aesthetically more pleasing and easier for applying sewing process in the garment production. Preferably, the first segment is a sealed tubular structure and contains internally free-floating yarns, making it exert less stress to the skin and thus more comfortable to the wearer. In addition, the different segments of the strap are made in a single integral weaving process and thus is conducive to industry automation.

14 Claims, 19 Drawing Sheets

(56) References Cited

U.S. PATENT DOCUMENTS

| | | | | | |
|---|---|---|---|---|---|
| 3,953,640 | A * | 4/1976 | Takada | 428/188 |
| 4,015,641 | A * | 4/1977 | Goff et al. | 139/384 R |
| 4,025,684 | A * | 5/1977 | Neidhardt | 442/206 |
| 4,174,739 | A * | 11/1979 | Rasero et al. | 139/388 |
| 4,638,513 | A * | 1/1987 | Woods | 2/268 |
| 4,665,951 | A * | 5/1987 | Ellis | 139/387 R |
| 4,668,545 | A * | 5/1987 | Lowe | 428/35.1 |
| 5,080,142 | A * | 1/1992 | Calamito et al. | 139/384 R |
| 5,098,756 | A * | 3/1992 | Henderson et al. | 428/36.3 |
| 5,564,476 | A * | 10/1996 | Golz | 139/388 |
| 5,749,400 | A * | 5/1998 | Pascual | 139/421 |
| 6,283,167 | B1 * | 9/2001 | Chang et al. | 139/383 R |
| 6,286,341 | B2 * | 9/2001 | Jackson et al. | 66/83 |
| 7,331,363 | B2 * | 2/2008 | Lanzi | 139/422 |
| 7,347,229 | B2 * | 3/2008 | Glenn et al. | 139/387 R |
| 7,406,986 | B2 * | 8/2008 | Lam | 139/384 R |
| 7,409,970 | B2 * | 8/2008 | Sollars, Jr. | 139/389 |
| 7,484,539 | B1 * | 2/2009 | Huang | 139/384 R |
| 7,490,634 | B2 * | 2/2009 | Resendez et al. | 139/423 |
| 7,628,180 | B1 * | 12/2009 | Golz | 139/409 |
| 7,628,435 | B1 * | 12/2009 | Golz | 294/74 |
| 7,677,360 | B2 * | 3/2010 | Tanaka et al. | 182/3 |
| 7,726,350 | B2 * | 6/2010 | Jennings et al. | 139/383 R |
| 7,815,013 | B2 * | 10/2010 | Griffith | 182/3 |
| 7,836,918 | B1 * | 11/2010 | Osborne | 139/421 |
| 7,891,717 | B2 * | 2/2011 | Golz | 294/74 |
| 8,317,568 | B2 * | 11/2012 | He | 450/41 |
| 8,348,318 | B2 * | 1/2013 | Petiot et al. | 294/74 |
| 8,353,326 | B2 * | 1/2013 | Chang et al. | 160/84.05 |
| 2004/0237599 | A1 * | 12/2004 | Kondou et al. | 66/202 |
| 2004/0267362 | A1 * | 12/2004 | Hwang et al. | 623/13.15 |
| 2007/0228226 | A1 * | 10/2007 | Taillon et al. | 248/60 |
| 2007/0267084 | A1 * | 11/2007 | Pereira et al. | 139/116.1 |
| 2008/0007077 | A1 * | 1/2008 | Petiot et al. | 294/149 |
| 2011/0104986 | A1 * | 5/2011 | He | 450/93 |
| 2011/0151155 | A1 * | 6/2011 | He | 428/34.1 |
| 2011/0237158 | A1 * | 9/2011 | He | 450/43 |
| 2012/0040579 | A1 * | 2/2012 | Russell | 442/184 |

* cited by examiner

FIG. 10

| | | | | | | | | | | | | | | | | |
|---|---|---|---|---|---|---|---|---|---|---|---|---|---|---|---|---|
| × | ○ | ○ | △ | ○ | ○ | △ | △ | △ | × | △ | △ | △ | △ | △ | × | △ |
| ○ | × | ○ | △ | △ | △ | △ | △ | △ | △ | ○ | × | △ | × | × | × | △ |
| × | ○ | ○ | ○ | ○ | △ | ○ | △ | △ | △ | △ | △ | △ | × | △ | △ | △ |
| ○ | × | △ | △ | ○ | △ | △ | △ | △ | △ | × | ○ | △ | × | △ | × | × |
| × | ○ | ○ | △ | ○ | ○ | △ | △ | × | △ | △ | △ | △ | △ | △ | × | △ |
| ○ | × | ○ | △ | △ | △ | △ | △ | △ | △ | ○ | × | △ | × | × | × | △ |
| × | ○ | ○ | ○ | ○ | △ | △ | ○ | △ | △ | △ | △ | △ | × | △ | △ | △ |
| ○ | × | △ | △ | ○ | △ | △ | △ | △ | △ | × | ○ | △ | × | △ | × | × |

Strap edge connecting position | Lower-layer structure | Free-floating yarn structure | Connecting yarn structure | Framework root line | Upper-layer structure

FIG. 11

| | | | | | | | | | | | | | | |
|---|---|---|---|---|---|---|---|---|---|---|---|---|---|---|
| × | ○ | ○ | △ | ○ | ○ | △ | × | △ | △ | ○ | △ | △ | × | △ |
| ○ | × | ○ | △ | △ | △ | ○ | △ | ○ | × | ○ | × | × | × | △ |
| × | ○ | ○ | ○ | ○ | △ | △ | × | △ | △ | ○ | × | △ | △ | △ |
| ○ | × | △ | △ | ○ | △ | ○ | △ | × | ○ | ○ | × | △ | × | × |
| × | ○ | ○ | △ | ○ | ○ | △ | × | △ | △ | ○ | △ | △ | × | △ |
| ○ | × | ○ | △ | △ | △ | ○ | △ | ○ | × | ○ | × | × | × | △ |
| × | ○ | ○ | ○ | ○ | △ | △ | × | △ | △ | ○ | × | △ | △ | △ |
| ○ | × | △ | △ | ○ | △ | ○ | △ | × | ○ | ○ | × | △ | × | × |

Strap edge connecting position | Lower-layer structure | Framework root line | Connecting yarn structure | Free-floating yarn structure | Upper-layer structure

FIG. 16

| | | | | | | | | | | | | | | |
|---|---|---|---|---|---|---|---|---|---|---|---|---|---|---|
| × | ○ | ○ | △ | ○ | ○ | △ | × | △ | △ | ○ | △ | △ | × | △ |
| ○ | × | ○ | △ | △ | △ | ○ | △ | ○ | × | ○ | × | × | × | △ |
| × | ○ | ○ | ○ | ○ | △ | △ | × | △ | △ | × | × | △ | △ | △ |
| ○ | × | △ | △ | ○ | △ | ○ | △ | × | ○ | × | × | △ | × | × |
| × | ○ | ○ | △ | ○ | ○ | △ | × | △ | △ | ○ | △ | △ | × | △ |
| ○ | × | ○ | △ | △ | △ | ○ | △ | ○ | × | ○ | × | × | × | △ |
| × | ○ | ○ | ○ | ○ | △ | △ | × | △ | △ | × | × | △ | △ | △ |
| ○ | × | △ | △ | ○ | △ | ○ | △ | × | ○ | × | × | △ | × | × |

Strap edge connecting position | Lower-layer structure | Framework root line | Connecting yarn structure | Free-floating yarn structure | Upper-layer structure

FABRIC STRAPS WITH TUBULAR STRUCTURE CONTAINING FREE-FLOATING YARNS AND VARIED WIDTH

CROSS-REFERENCE TO RELATED APPLICATIONS

This application claims benefit from U.S. provisional application No. 61/549,746, filed Oct. 20, 2011, the content of which is incorporated herein by reference.

FIELD OF THE INVENTION

The present invention relates to the field of fabricating fabric straps used in garment industry. More specifically, it relates to a fabric strap with varied width and, preferably, filled with internal free-floating yarns, particularly useful in female undergarments.

BACKGROUND OF THE INVENTION

The fabric strap is an important article in the garment industry, where technique innovation has brought about generations of updated products. Particularly, such advance has greatly improved the design for visual effects with respect to graphic patterns, colors, and post-fabrication modifications. In contrast to the advance in visual designs, however, no significant progress has been made in terms of structure and functionality of the fabric strap. Mostly, the fabric strap stays in the form which is uniform in thickness and in width, which cannot generally meet users' need for comfortableness in wearing the undergarment. Taking the shoulder strap in female underwear for example, the shoulders are typically under a greater stress caused by the strap when the underwear is worn. The shoulder strap should be wider, thicker and softer in the section or segment which is in contact with the shoulder. On the other hand, for the segment in contact with the chest and the back, there is a lower stress exerted on the strap and thus the strap should be lighter and thinner, which would be aesthetically more pleasing and also make the sewing process easier. Taking the waist belt for another example, both the sides of the waist bear a higher stress, especially in people with overweight, and can easily generate red imprinted marks on the skin. Some prior effort has been made to solve the problem. For example, Chinese Patent No. 200520053900.9 disclosed a fabric strap which is a woven fabric comprising a segment which is a tubular structure. At such segment, there is provided a lateral penning through which soft loose fillers can be inserted into the segment and, to prevent the fillers entering other parts of the strap, the segment is provided with closure means at both ends. While such a strap has a segment stuffed with soft filler at the places where softness is desired to relieve the stress exerted on the skin, the solution is time-consuming and thus increases the cost of the production. Furthermore, it also produces inferior visual effects.

Another effort is also known, which provides a fabric strap with varied width, that is, having a segment which is wider than other segments and such wider segment corresponds to an area which exerts greater stress on the user, such as in the shoulder area. However, for such strap to be made in a single integral woven process, the width is generally correlating to the longitudinal elasticity, i.e., the wider the segment is, the greater the elasticity is. This property is undesirable because for the strap used in the undergarment, the segment in contact with the shoulder, for example, needs a wider width to relieve the stress exerted on the shoulder but it should also need a lower elasticity so that it can sufficiently sustain the weight of the breasts. To address this problem, a frequently used method is to connect (usually by sewing) a wider segment of a lower elasticity with narrower segments of higher elasticity, instead of making it in single integral woven process. Obviously, such method complicates the production processes and is unsuitable for automation, resulting in a reduced production efficiency. In addition, the sewing seams between the connected segments can cause skin allergies, red imprints, or uncomfortable feel, due to the friction between them and the skin.

SUMMARY OF THE INVENTIONS

One object of the present invention is accordingly to provide an integral woven fabric strap with varied width. The strap is produced in a single integral woven process and requires no additional sewing step and it comprises wider sections and narrower sections connected alternatively. The wider section has lower elasticity and higher strength, whereas the narrower section has higher elasticity and lower strength. The wider section provides a larger contact surface between the strap and the skin, and reduces the stress exerted on the skin. At the same time, its lower elasticity and higher strength increase the shoulder strap as well as the underwear's ability to support even the most fully-developed breasts and help maintain them in a perfect cleavage profile. The narrower section with a smaller width makes the appearance of underwear aesthetically more pleasing.

In another aspect of the present invention, there is provided an integral woven fabric strap with varied width, which comprises two types of integrally woven segments or sections. One type of the segment is wider and is a tubular structure containing internally a plurality of free-floating yarns, making it relatively thicker, fluffier, softer and functioning like a cushion. The other type of the segment is narrower, thinner and lighter. The two types of segments are integrally woven together through the change of warp and weft interweaving patterns and do not require additional step of sewing to connect them. The free-floating yarns are independent warp yarns integrally woven with the main body of the strap and fixed at the interface between the two types of segments. Within the first type of segment (i.e. the one which is thicker, fluffier and wider), the free-floating yarns are entirely internal (thus, cannot be seen) and loosely fill the internal space of a tubular structure with the two ends fixed at the upper and lower ends of the segments, respectively. This type of segment is usually positioned at the shoulder position (for a should strap) or the side positions (for a waistband). For being wider, thicker and softer, these segments relieve the fabric strap's stress on the skin and make it feel more comfortable to the wearers. The free-floating yarns continue to the interface between the two types of segments, which can be either integrated and woven into the second type segment (i.e., the thinner and narrower segment) where two layers of the tubular structure and free-floating yarns from the first type segment are all integrated into a single layered, non-tubular structure which becomes the second type segment, or alternatively the free-floating yarns are running to the outside of the strap and be cut off while the two layers of the tubular structure are integrated into a single layer of the second type segment and thus become thinner, lighter, and smoother. As such, the second type segment is aesthetically more appealing and easier for applying the sewing process in the production of the garment.

These and some other objects have been achieved by practicing the present invention as exemplified in the detailed description section of this application.

The various features of novelty which characterize the invention are pointed out with particularity in the claims annexed to and forming a part of this disclosure. For a better understanding of the invention, its operating advantages, and specific objects attained by its use, reference should be made to the drawings and the following description in which there are illustrated and described preferred embodiments of the invention.

BRIEF DESCRIPTION OF THE DRAWINGS

FIG. 10 is the weaving pattern for the first type segment which contains internal free-floating yarns of the fabric strap of FIG. 4.

FIG. 11 is the weaving pattern for the second segment where the free-floating yarns are are exposed to the outside of the fabric strap of FIG.4.

FIG. 16 is a further variation of the fabric strap according to the present invention where in the second type segment the free-floating yarns from the first type segment are interwoven in and become part of the second type segment without needing the cutting-off step.

DETAILED DESCRIPTION OF PARTICULAR EMBODIMENTS OF THE INVENTION

Figure 1:
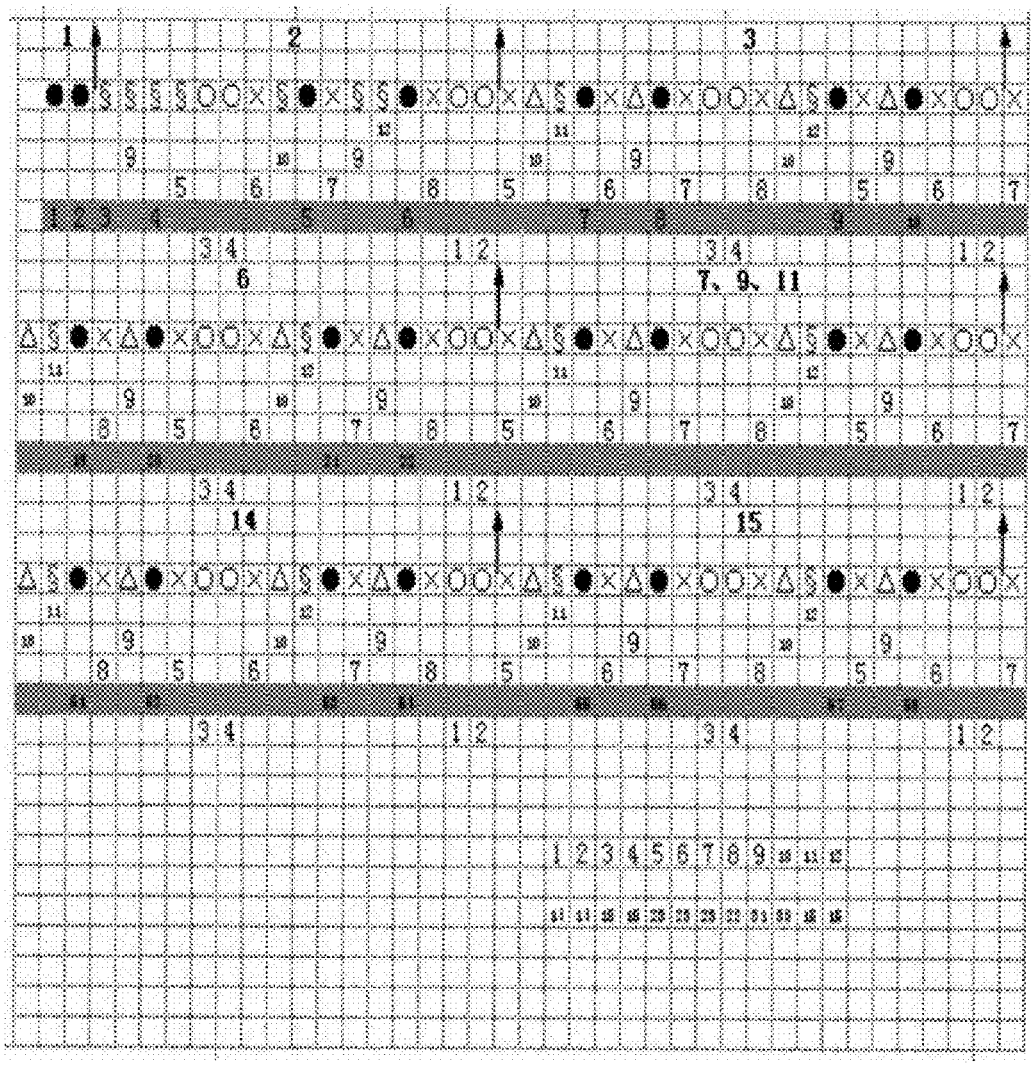
FIG. 1 is the drafting plain of fabricating an exemplary fabric strap of the present invention (a: left half, b: right half).
Figure 1B:
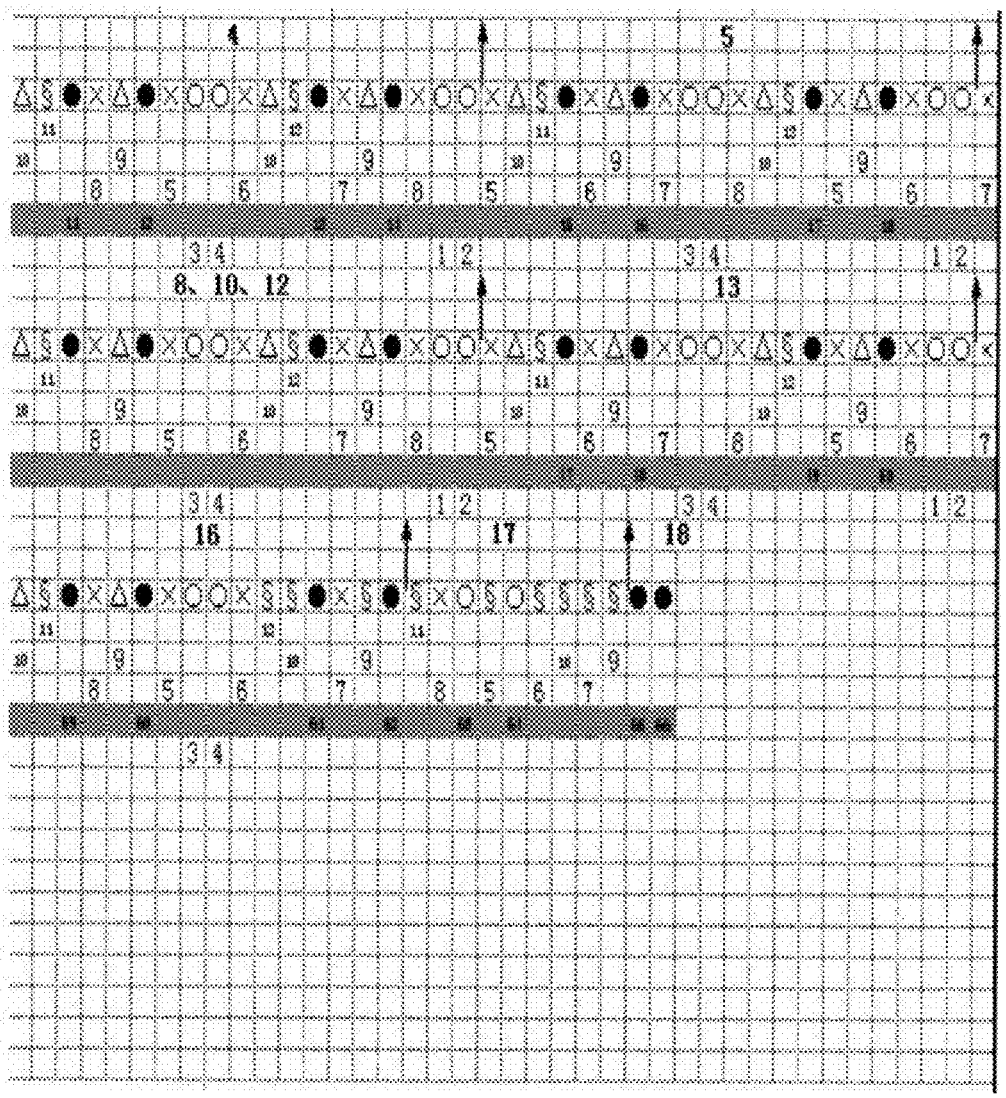

For all the embodiments described herewith, the fabricating equipment used is an electronic shuttleless loom, manufactured by Muller of Swiss (Model No: NFJM2 4/42).

Type I: Fabric Straps with Varied Width (1) Warping Preparation. The warps include: surface yarns (x): 78/48/1 TB Nylon, 87 ends; base yarns (§) 44/34/2SD Nylon, 43 ends; yarns with two in the lower position and two in the middle position(Δ) 44/12/2 SD Nylon, 54 ends; adjusting Spandex yarns, which is covered 310 dtex spandex wrap yarns (●, 62 ends; framework Spandex yarns, which is 78 dtex covered spandex wrap yarn (○), 60 ends. All yarns pass through the warping pan head for warp preparation.

(2) Drafting: All warps are threaded through the heddles according to the sequence specified by the pre-determined weaving pattern (which specifies the sequence of harnesses and heddles being raised and lowered in pre-deigned sequences) as shown FIG. 1.

(3) Adjust thread counts: The weft thread count in the wider segment is 21 picks/centimeter. From the wide segment to the narrow segment, the weft thread count of the first 200 wefts progressively decreases from 21 picks/centimeter to 16.4 picks/centimeter. In the last 200 wefts, the thread count increases progressively from 17.3 picks/ centimeter to 21 picks/centimeter. The weft thread count in the narrower segment is 21 picks/centimeter. From the narrower segment to the wider segment, the thread count is changing in the opposite direction, i.e. from 21 to 17.3 and then from 16.4 to 21 picks/centimeter.

(4) Strap width and reed: The width of the fabric strap of this example is 15 MM (millimeters) at the widest location and 12 MM the narrowest location. The width is controlled by the reed. An exemplary reed is Y-typed with the specification of 22/31 (that is, 22 sluts per inch at the upper widest position and 31 sluts per inch at the lower narrowest position). The yarns are threaded through the Y-type reed according to a pre-determined drafting plan and weaving pattern.

(5) Wefts: The upper wefts are 44/12/1 SD Nylon, the lower wefts are 44/12 SD Nylon and the lock thread is 44/12/1 SD Nylon.

Figure 8:
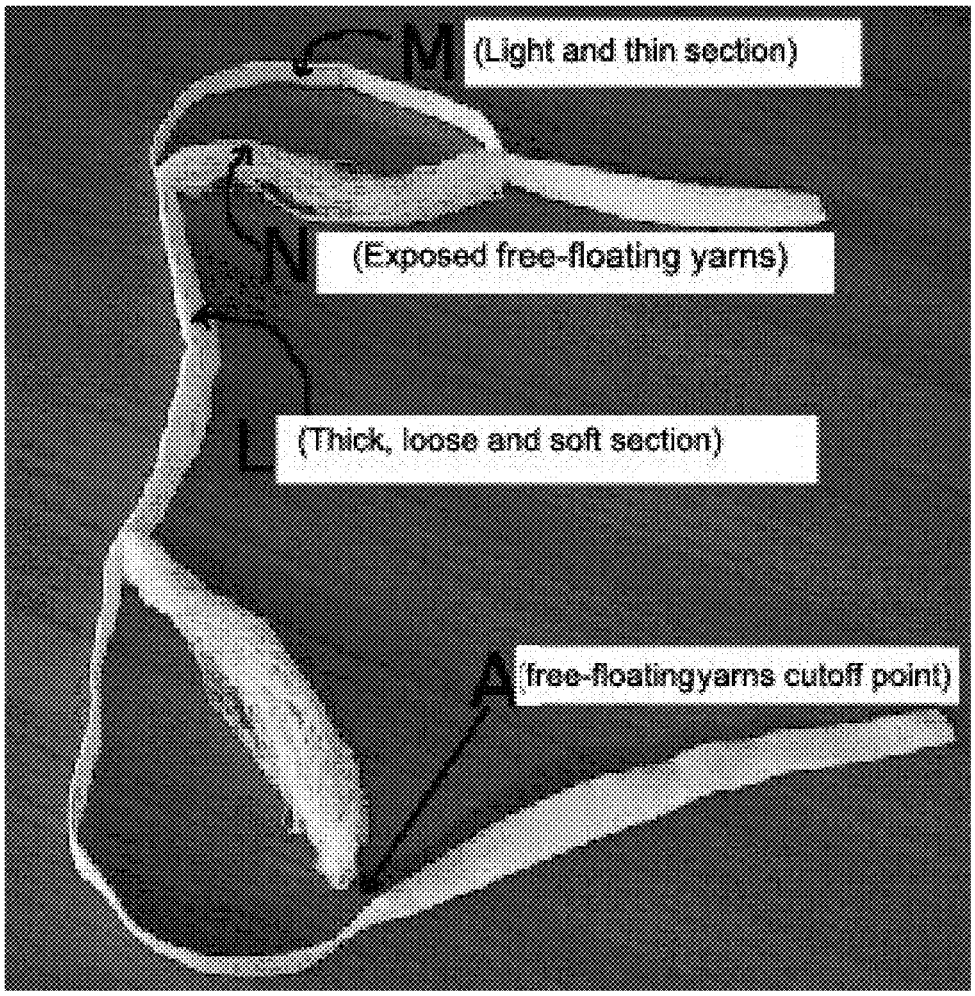
FIG. 8 is a photograph of a semi-finished fabric strap according to FIG. 4.

(6) Motion Rules and Weaving Patterns: In both the wider and narrower segments, the upper layer of strap is the same structure and both are interwoven with upper-layer wefts 44/12/1 SD Nylon, upper-layer warps 78/48/1 TB Nylon and 78 dtex covered spandex wrap yarns. The weaving pattern for warps 78/48/1 TB Nylon is two 3×1 chains (i.e., three in the upper position-one in the middle position), the weaving pattern for warps 78 dtex covered spandex is one 1×1 chain (i.e., one in the upper position-one in the middle position), as shown in FIG.8. In both the wider and narrower segments, the lower base layer is the same structure and both are interwoven with lower-layer wefts 44/12 SD Nylon, lower-layer warps 44/34/2 SDNylon, 44/12/2 SD Nylon and 78 dtex covered spandex yarns. The weaving pattern for warps 44/34/2 SD Nylon is two 6×2 chains (i.e., six in the lower position and two in the middle position). The weaving pattern for warps 44/12/2 SDNylon is two 2×2 chains (i.e., two in the lower position-two in the middle position). The weaving pattern for warps 78 dtex covered spandex is one 1×1 chain (i.e., one in the lower position-one in the middle position), as shown in FIG. 2.

Figure 3:
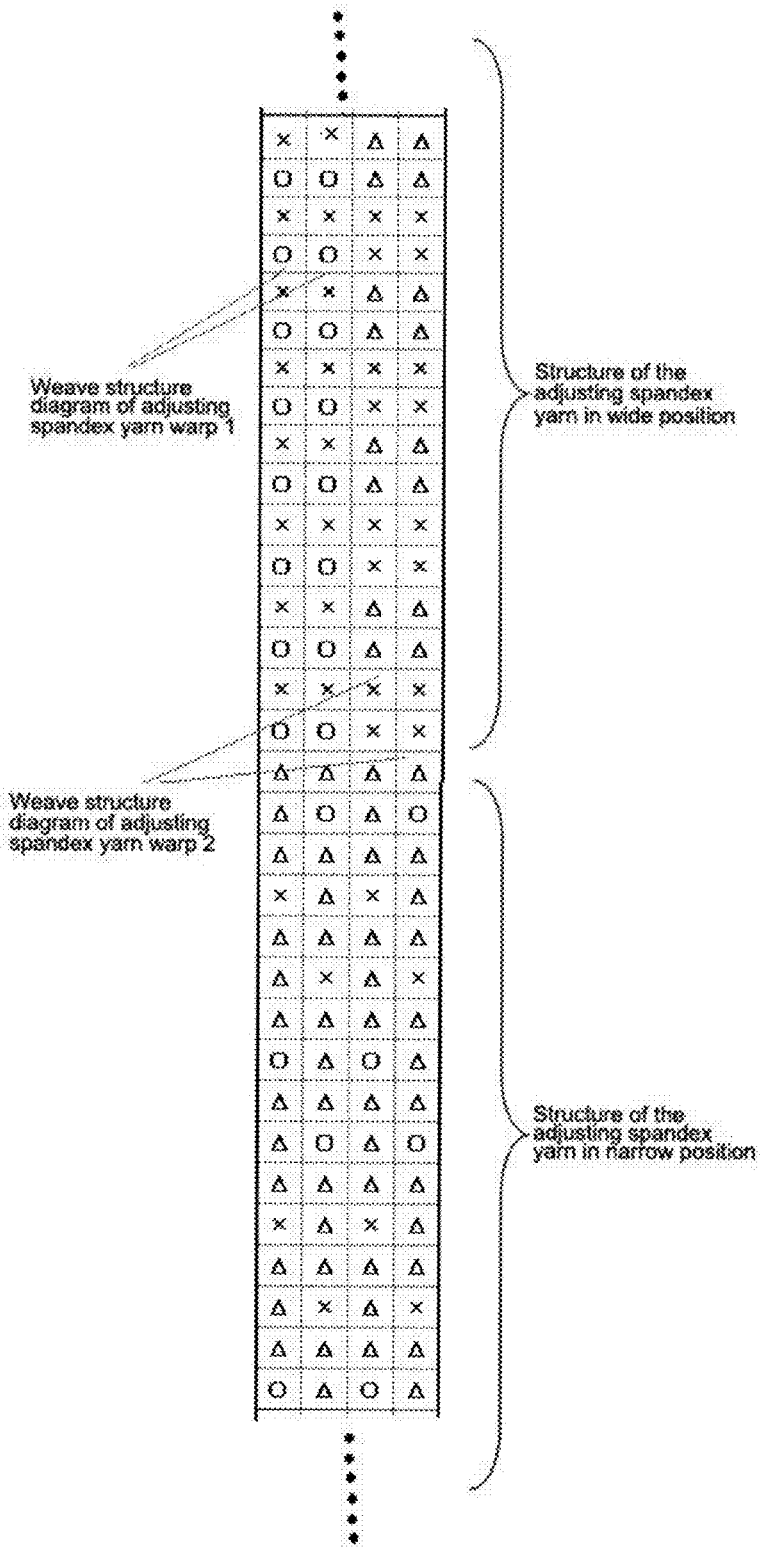
FIG. 3 shows the weaving pattern of the adjusting spandex yarn warps 310 dtex in the first segment and second segment.

Adjusting spandex yarn warps 310 dtex (covered spandex) wrap yarns pass through individual heddles. In the wider segment, one half of adjusting spandex yarn warps are interwoven with both the upper-layer warps and lower layer warp simultaneously in the weaving pattern: one in the upper position-one in the lower position as shown in FIG. 3. The other half is interwoven with the lower-layer warps in two chains of the weaving pattern: two in the lower position and two in the middle position as shown in FIG. 3. In the narrower segment, adjusting 310 dtex covered spandex wrap yarns are interwoven with the upper-layer and lower-layer warps, ith the weaving pattern: three in the middle position-one in the upper position-three in the middle position-one in the lower position as shown in FIG. 3.

Figure 2:
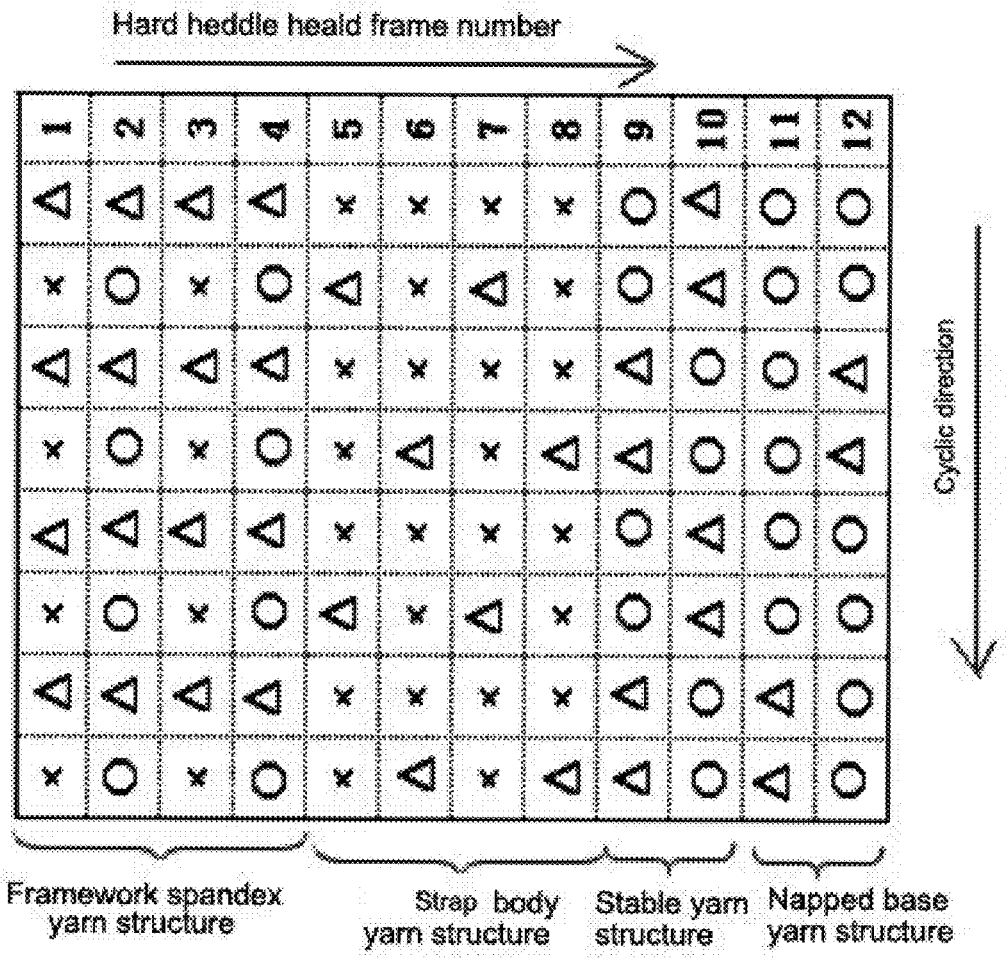
FIG. 2 shows the weaving pattern for the exemplary fabric strap of FIG. 1.

Heald frame and computer controlled individual heddles drive the up-and-down motion of heddles to divide warps into upper layer and lower layer to form an opening (shed) according to the required weave diagrams (as shown in FIG. 2 and FIG. 3).

(7) Weft Insertion (picking) and Beating-up: The weft hook drives wefts to traverse the opening and the latch needle winds up the wefts or edges. Wefts adjust the weft yarn conveying device through the weft density adjusting gear: within the wide zone, more weft yarns are fed in; within the narrow zone, less weft yarns are fed in. The reed swings to make wefts passing through the opening firm and form a fabric strap.

(8) The rubber wheel rotates to wind up the strap and the driving device adjusts thread density (count) at different segments of the strap.

(9) Post-processing, forming and dyeing.

Preferable weaving patterns of the upper layer, lower layer and fill layer of the fabric strap of this exemplary strap are shown in FIG. 2 and FIG. 3, which however are provided only as examples of, not limitations to, the present invention. The meaning of the symbols used in figures is as follows: × indicates the warps in the upper position; Δ indicates the warps in the middle position and ○ indicates the warps in the lower position. Other weaving patterns, of course, may also be used. Some suitable weaving patterns for the upper layer are exemplified as follows: three in the upper position-one in the lower position, five in the upper position-one in the lower position, five in the upper position-one in the middle position, two in the upper position-two in the middle position, one in the upper position, one in the middle position, one in the lower position and one in the middle position, or other similar structures. Some suitable weaving patterns for the base layer are exemplified as follows: three in the lower position and one in the middle position, three in the middle position and one in the lower position, five in the lower position-one in the middle position, five in the lower position-one in the upper position, three in the lower position-one in the upper position, seven in the lower position-one in the middle position, seven in the lower position-one in the upper position, five in the lower position-one in the middle position-one in the lower position-one in the middle position, etc.

Suitable weaving patterns for the adjusting spandex yarn warps in the wider segment includes, for example, one in the upper position-one in the middle position, two in the upper position-two in the middle position, one in the upper position-one in the middle position-one in the lower position-one in the middle position, two in the upper position-two in the middle position-two in the lower position-two in the middle position. Suitable weaving patterns for the adjusting spandex yarn warps in the narrower segment includes, for example, three in the middle position-one in the lower position-three in the lower position-one in the middle position, five in the middle position-one in the lower position-five in the lower position-one in the middle position, two in the lower position-two in the middle position, three in the middle position-one in the lower position, three in the lower position-one in the middle position, five in the lower position-one in the middle position, five in the lower position-one in the upper position, three in the lower position-one in the upper position, seven in the lower position-one in the middle position, seven in the lower position-one in the upper position, etc.

The outer surface of the strap is a napped surface or an unnapped surface. The strap of the present invention can use Chinlon, Spandex, Polyester and other raw materials. In case that the outer surface is napped, it can use Chinlon, which shows a better effect. The raw materials that may be used in practicing the present invention are not limited to those disclosed in the specification, and should be determined according to the required parameters like thickness, elasticity, strength, width, etc.

Type II: Fabric Straps with Varied Width and Internal Free-floating Yarns

Figure 4:
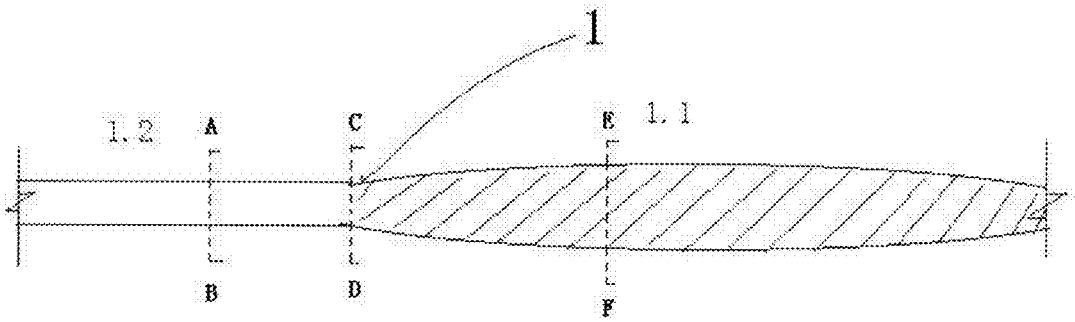
FIG. 4 is a diagram showing the overall shape of another exemplary fabric strap of the present invention.
Figure 5:
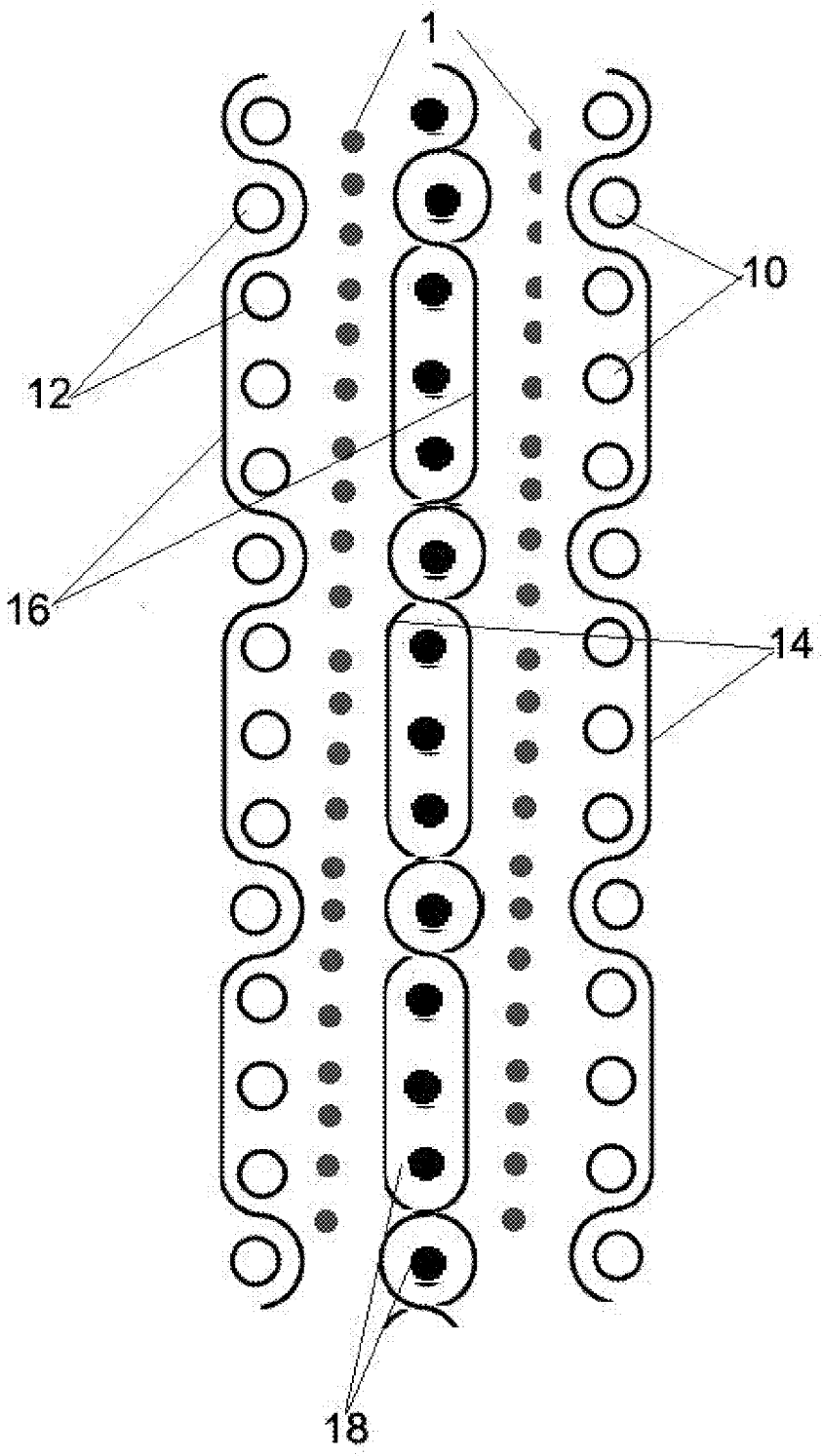
FIG. 5 is a diagram showing the cross-section along the E-F line indicated in FIG. 4, illustration the arrangement of warps and wefts.
Figure 6:
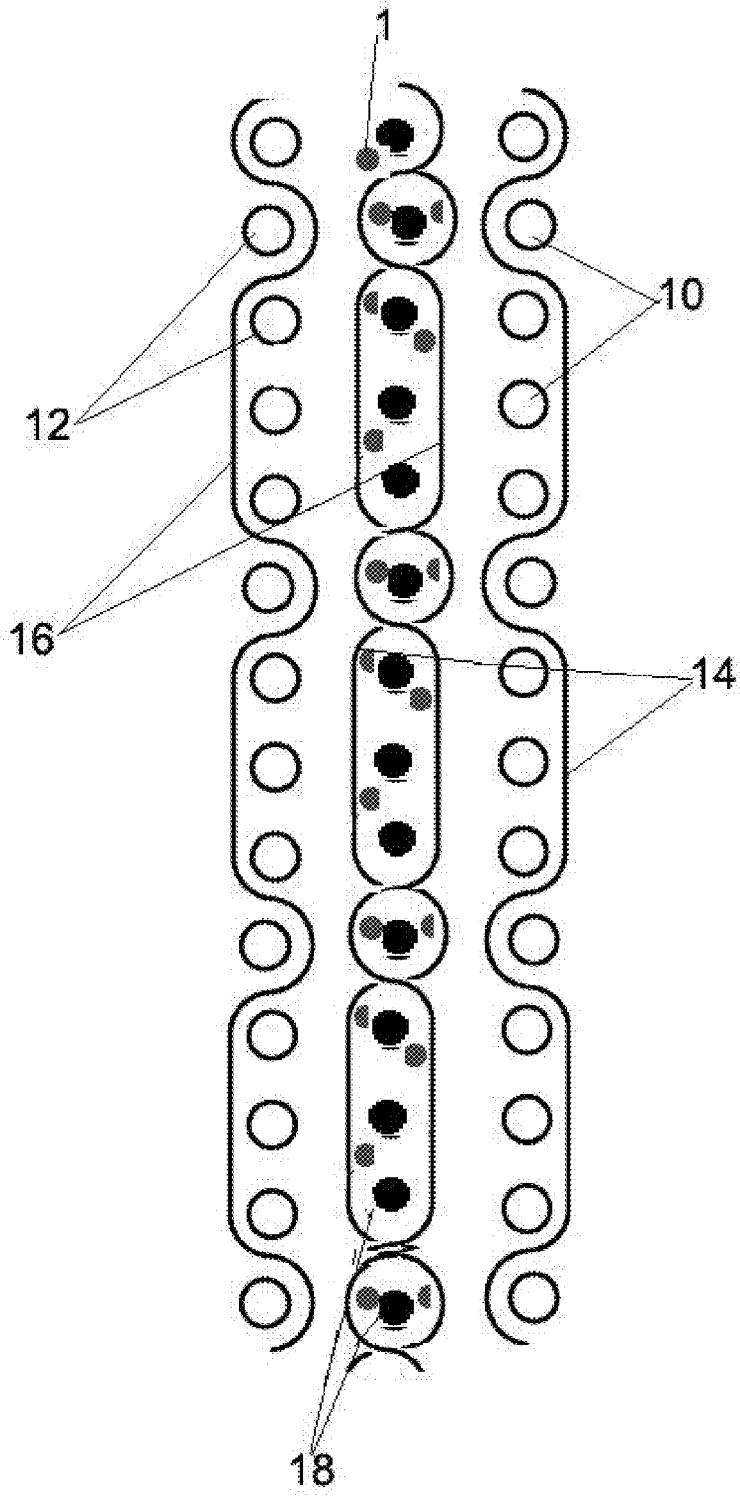
FIG. 6 is a diagram showing the cross-section along the C-D line indicated in FIG. 4, illustration the arrangement of warps and wefts.
Figure 7:
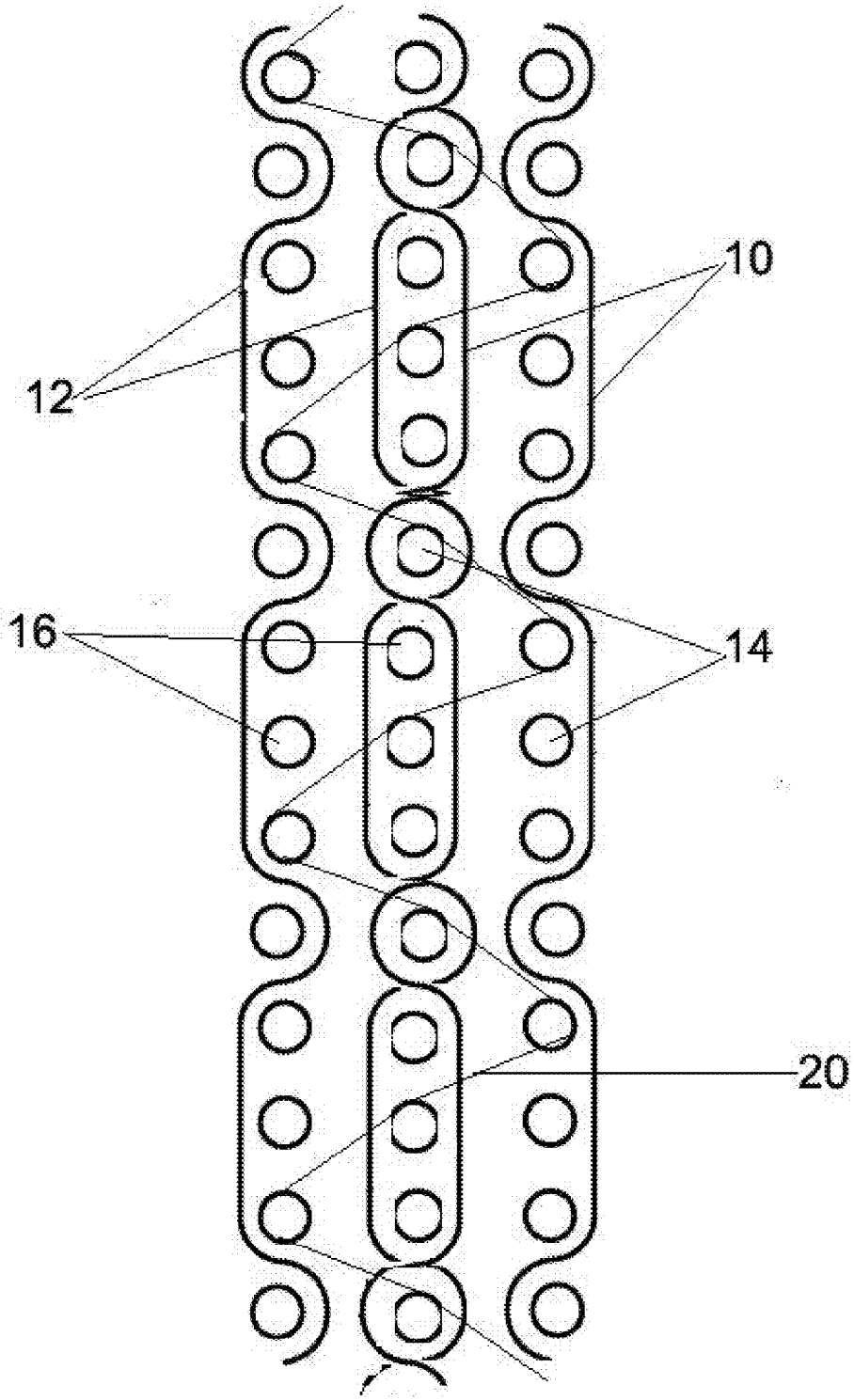
FIG. 7 is a diagram showing the cross-section along the A-B line indicated in FIG. 4, illustration the arrangement of warps and wefts.

This particular embodiment of the present invention provides a fabric stripe whose overall shape is shown in FIG. 4. FIGS. 5, 6 and 7 are diagrams of the cross-sections along the E-F, C-D, and A-B lines (shown in FIG. 4), respectively, showing the arrangement of warps and wefts. In the FIG. 1 is the free-floating yarns, 10 is lower layer warps, 12 is upper layer warps, 14 is lower layer wefts, 16 is upper layer wefts, 18 is framework yarns, and 20 is connecting yarns. FIG. 8 is photo of a semi-finished product showing the free-floating yarns exposed to the outside of the second type segments before being cut off, where L is the first type segment, M is the second type segment, N is the exposed free-floating yarns and A is the point from which the exposed free-floating yarns are cut off.

(1) Warping Preparation: Warps include the following: free-floating yarns (●) 111/36/2 SD Nylon, 81 ends; framework spandex yarns (○) 930 dtex spandex, 28 ends; upper-layer yarns×44/34/2 SD Nylon, 93 ends; lower-layer yarns §44/34/2 SD Nylon, 93 ends; yarns connecting the upper layer and lower layer (▲) 78/24/2SD Nylon, 31 ends; upper and lower double-layer yarns (Δ) 44 dex spandex, 60 ends (30 are in the upper layer and the other 30 are in the lower layer). All yarns pass through the warping pan head for preparation.

(2) Drafting: All warps are threaded through the heddle according to the predetermined draft plain as shown FIG. 9.

(3) Thread count: The weft thread count the first type of segment (i.e., the segment containing free-floating yarns) is 11.7 picks/cm (centimeter) and it is 25 picks/cm in the second type of segment (i.e., the segment without free-floating yarns) as well as in the transition area (i.e., the interface between the first type segment and the second type segment.

(4) Width and Reed: the strap width is controlled by varying the reed's orientation. The widest width of the strap is 17 mm (millimeter) and the narrowest width is 14 mm. The reed used is a Y-type reed with the specification of 15/30 (i.e. there are 15 sluts per inch at the upper widest position and 30 sluts per inch at the lower narrowest position). The yarns are threaded through the Y-type reed according to the reeding order of the drafting plan shown in FIG. 9.

(5) Wefts: Both the upper wefts and lower wefts are 78/24 SD Nylon and the lock yarn is 78/24/1 SDNylon.

(6) Motion Rules and Weaving Patterns: The first type segment (i.e., with free-floating yarns) is a tubular structure. As shown in FIG. 10, the upper-layer fabric is woven with upper-layer wefts and upper-layer warps in the weaving pattern: (1) three in the up position-one in the middle position, and (2) three in the middle position-one in the up position, as shown in FIG. 5. Its lower-layer fabric is woven with lower-layer wefts and lower-layer warps in the weaving pattern: (1) three in the middle position-one in the lower position, and (2) three in the lower position-one in the middle position. The free-floating yarns as a soft filling layer are connected with the wefts in the middle in the weaving pattern: (1) one in the upper position-seven in the middle position, and (2) one in the lower position-seven in the middle position. Yarns connecting the upper layer and lower layer (▲) are in the weaving pattern: one in the upper position-one in the middle position-one in the lower position-one in the middle position, and are interwoven with the framework of spandex yarns (○) 930 dtex spandex to form the middle-layer fabric.

As shown in FIG. 11, the second type segment (i.e., one without free-floating yarns) comprises upper-layer fabric, lower-layer fabric and some connecting yarns. The upper-layer fabric is woven with upper-layer wefts and upper-layer warps in the weaving pattern: (1) three in the upper position-one in the middle position, (2) three in the middle position-one in the upper position. One half of the framework spandex yarns ○ (930dtex spandex) are interwoven with the upper-layer warps in the weaving pattern: one in the upper position-one in the middle position. The lower-layer fabric is woven with lower-layer wefts and lower-layer warps in the weaving pattern: three in the middle position-one in the lower position-three in the lower position-one in the middle position. Another half of the framework spandex yarns ○ (930 dtex spandex) are interwoven with the lower-layer warps in the weaving pattern: one in the lower position-one in the middle position. Yarns connecting the upper layer and lower layer ▲ in the weaving pattern: one in the upper position-one in the middle position-one in the lower position-one in the middle position to connect the upper-layer fabric and lower-layer fabric. The free-floating yarns are all in the lower position.

At the transition area (i.e., the interface between the two types of segment), the free-floating yarns are interwoven with both the upper-layer and lower layer yarns in a weaving pattern: one in the upper position-one in the lower position. Thus, the floating yarns are fixed at both ends at the transition areas.

Heald frames and computer-controlled individual heddles drive the up-and-down motion of heddles to divide warps into upper layer and lower layer and to form an opening (shed) according to the predetermined weaving patterns (shown in FIG. 5 and FIG. 6).

(7) Weft Picking and Beating-up: The weft hook drives wefts to traverse the shed and the latch needle winds up the wefts or edges. Wefts adjust the weft yarn conveying device through the weft density adjusting gear so that within the wider segment, more weft yarns are fed in, leading to a higher weft thread count; within the narrower segment, less weft yarns are fed in, resulting in lower weft thread count.

(8) The rubber wheel rotates to wind up the strap and the thread count is adjusted by the driving device so that the weft thread count can be varied at different segments.

(9) The free-floating yarns which are exposed to the outside the strap in the second type of segments are cut off in the semi-finished product.

(10) The final step is then carried out, i.e., forming and dyeing.

Weaving Patterns for the Segment Containing Free-Floating Yarns

Figure 9A:
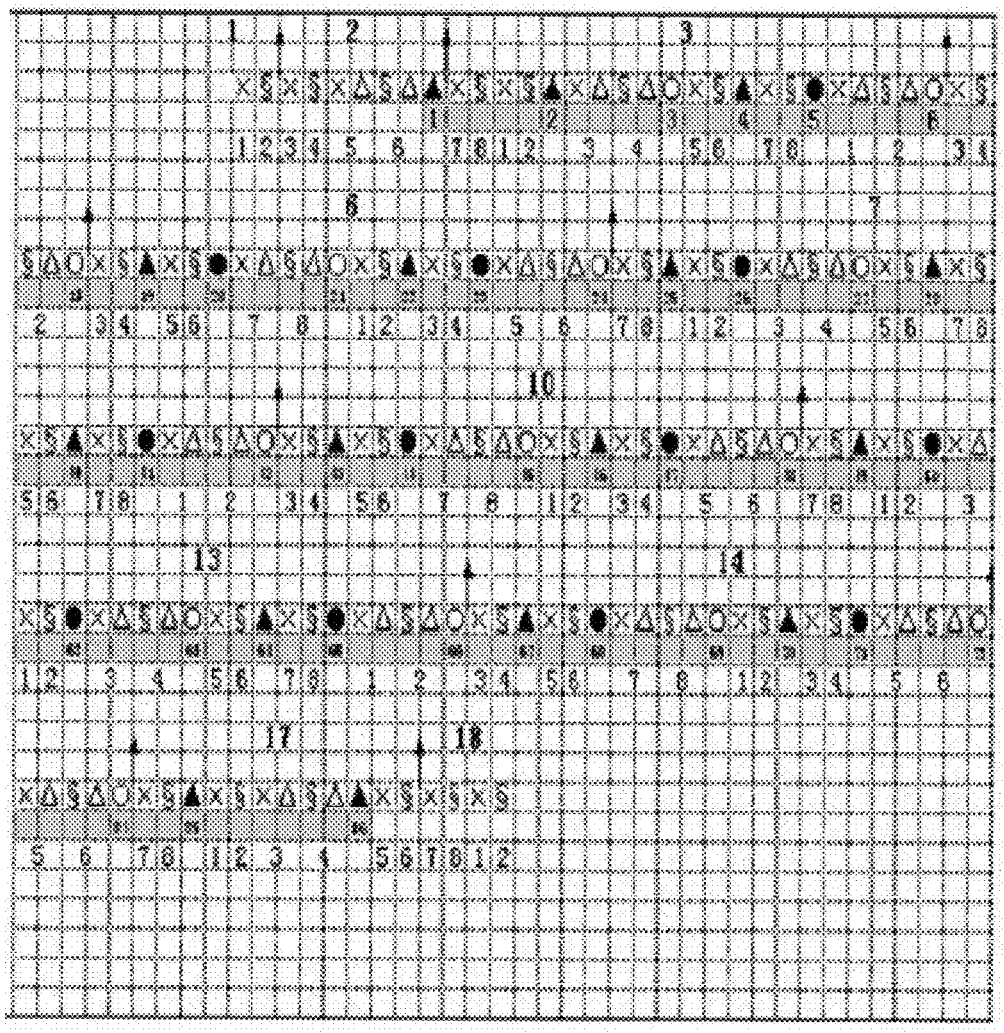
FIG. 9 is the drafting plain for fabricating the exemplary fabric strap of the present invention shown in FIG. 4 (a: left half, b: right half).
Figure 9B:
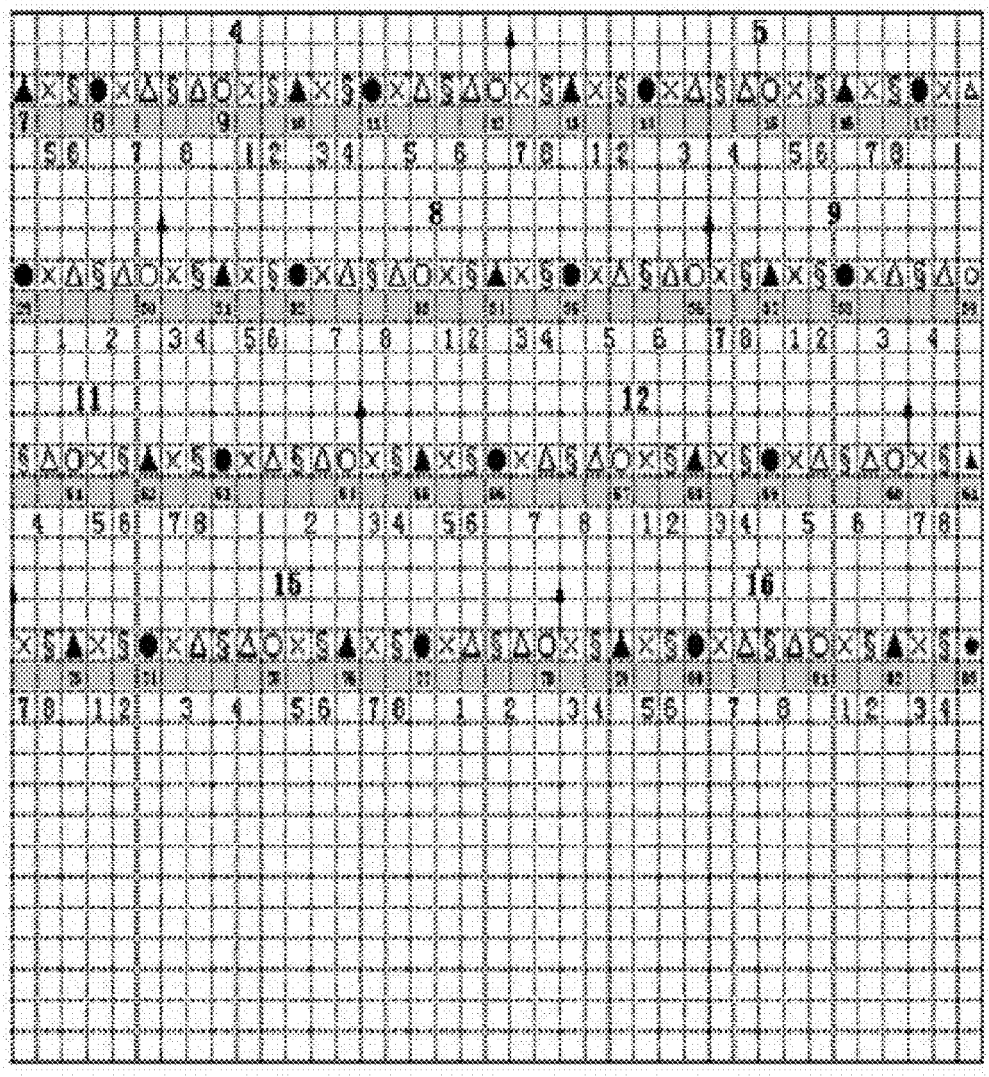

Preferred weaving patterns for the upper layer, lower layer and fill layer of the fabric strap of the present invention are shown in FIGS. 9, 10 and 11. However, they are provided as examples only, not as limitations to the present invention. The meaning of the symbols used in figures is as follows: × indicates the warps in the upper position; Δ indicates the warps in the middle position and ○ indicates the warps in the lower position. For the segment containing internal free-floating yarns (i.e., the first type segment), suitable weaving patterns for the upper layer fabric include, for example, three in the upper position-one in the middle position-three in the middle position-one in the upper position, five in the upper position-one in the middle position-five in the middle position-one in the upper position, one in the upper position and one in the middle position, two in the upper position-two in the middle position, three in the upper position-one in the middle position, three in the middle position-one in the upper position, three in the upper position-one in the lower position, five in the upper position-one in the middle position, five in the upper position-one in the lower position, etc. Suitable weaving patterns for the lower-layer fabric include, for example, three in the middle position-one in the lower position-three in the lower position-one in the middle position, five in the middle position-one in the lower position-five in the lower position-one in the middle position, one in the lower position-one in the middle position, two in the lower position-two in the middle position, three in the middle position-one in the lower position, three in the lower position-one in the middle position, five in the lower position-one in the middle position, five in the lower position-one in the upper position, three in the lower position-one in the upper position, seven in the lower position-one in the middle position, seven in the lower position-one in the upper position, etc. Suitable weaving patterns for the free-floating yarns include, for example, all in the middle position, one in the upper position-one in the middle position-one in the lower position, one in the upper position-seven in the middle position-one in the lower position-seven in the middle position, or one in the upper position-nine in the middle position-one in the lower position-nine in the middle position, etc. The weaving pattern for framework spandex yarns generally is: all in the middle position. The weaving pattern for the connecting yarns include, for example, one in the upper position-one in the middle position-one in the lower position-one in the middle position, two in the upper position-two in the middle position-two in the lower position-two in the middle position, etc.

Weaving Patterns for the Segment without Free-Floating Yarns

The weaving patterns for the upper-layer fabric includes, for example, three in the upper position-one in the middle position-three in the middle position-one in the upper position, five in the upper position-one in the middle position-five in the middle position-one in the upper position, one in the upper position-one in the middle position, two in the upper position-two in the middle position, three in the upper position-one in the middle position, three in the middle position-one in the upper position, three in the upper position-one in the lower position, five in the upper position-one in the middle position, five in the upper position-one in the lower position, etc. The weaving patterns for the lower-layer fabric include, for example, three in the middle position-one in the lower position-three in the lower position-one in the middle position, five in the middle position-one in the lower position-five in the lower position-one in the middle position, one in the lower position-one in the middle position, two in the lower position-two in the middle position, three in the middle position-one in the lower position, three in the lower position-one in the middle position, five in the lower position-one in the middle position, five in the lower position-one the upper position, three in the lower position-one in the upper position, seven in the lower position-one in the middle position, seven in the lower position-one in the upper position, etc. The weaving patterns for the free float yarns include, for example, all in the middle position, one in the upper position-one in the middle position-one in the lower position, one in the upper position-seven in the middle position-one in the lower position-seven in the middle position, one in the upper position-nine in the middle position-one in the lower position-nine in the middle position, etc.

The outer surface of the fabric strap can be napped or non-napped surface. The raw material of the yarns used can be Chinlon, Spandex, Polyester, to name just a few. The free-floating yarns can be Chinlon, Spandex, Polyester or other fluffy raw materials. For a napped outer surface, a preferred material is Chinlon, which shows a better effect. The raw material selection for practicing the present invention is within ordinary skill in the art and therefore is not part of the present invention. In general, material selection is determined according to required parameters such as, for example, thickness, elasticity, and width of the strap. The material and the number of free-floating yarns are determined according to the plumpness and the degree of the cushion effect.

The fabric strap of the present invention can be elastic or non-elastic. It can also be of a plain weaving pattern or a decorative pattern, and decorative edgings may be added as desired.

As a variation of the present invention, the strap may contain the segment of the first type, that is, segment containing internal free-floating yarns in a tubular woven structure divided by a middle layer of framework yarns, but unlike the previous mode where both sides of the middle layer are filled with free-floating yarns, only one side of the middle layer is filled with free-floating yarns. This mode may be preferable in some situations because one side of the strap is soft with cushion effects due to the presence of free-floating yarns while the surface of the other side is more flat, smooth and flushed with the narrower section (i.e. the half without free-floating yarns), which is esthetically more pleasing.

For the above variation, there are 60 threads of free-floating yarns ● 111/36/2 SD Nylon (the number of threads and the type of the raw material can be changed as desired according to particular requirements in terms of cushioning effect and thickness) in the weaving pattern: seven in the middle position-one in the upper position (other pattern may also provide satisfactory results, such as, for example, seven in the middle position-one in the lower position, five in the middle position-one in the upper position, all in the middle position, eleven in the middle position and one in the upper position, etc.). Other structures and steps of the making the strap are the same as described in the foregoing for the other mode.

Figure 12:
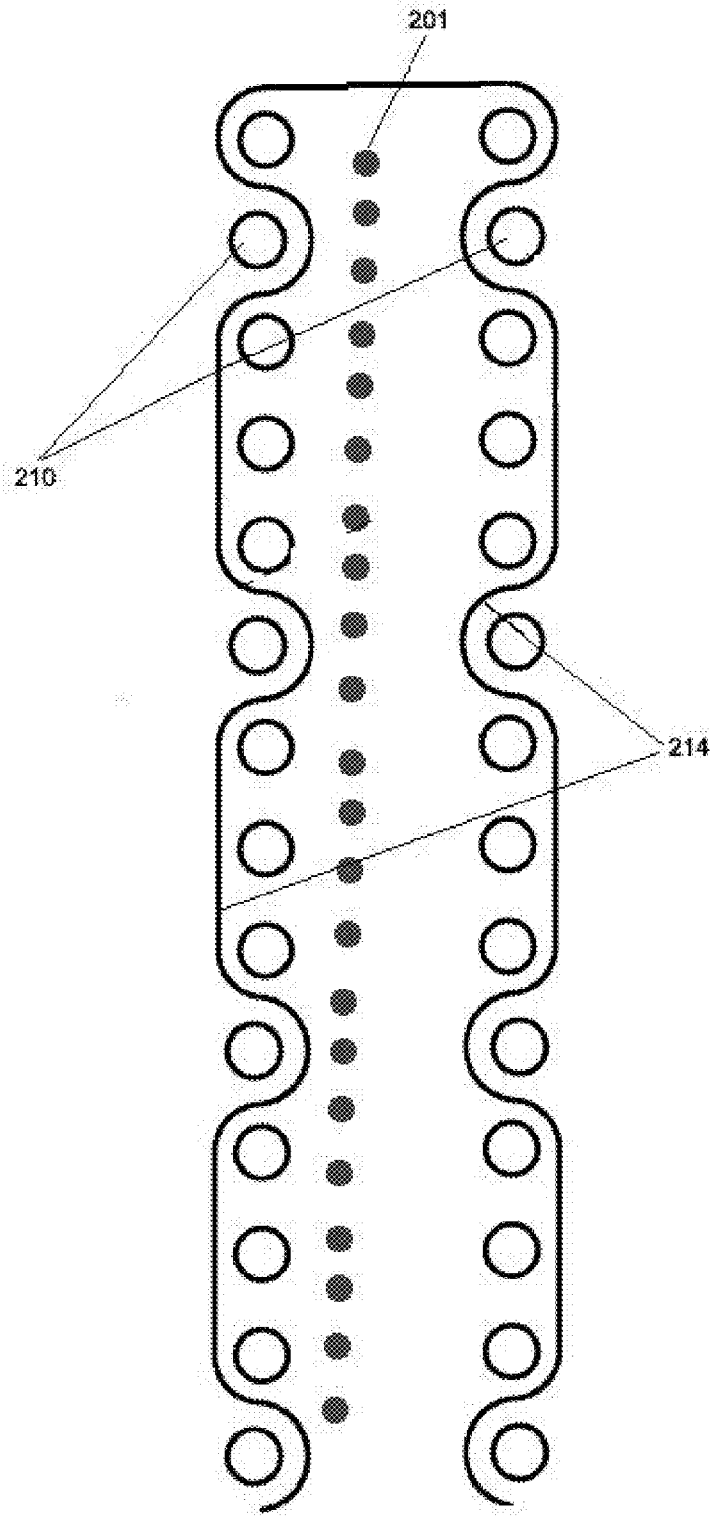
FIG. 12 is another variation of the fabric strap according to the present invention which does not have a middle layer separating the internal space of the tubular structure of the first segment.
Figure 13:
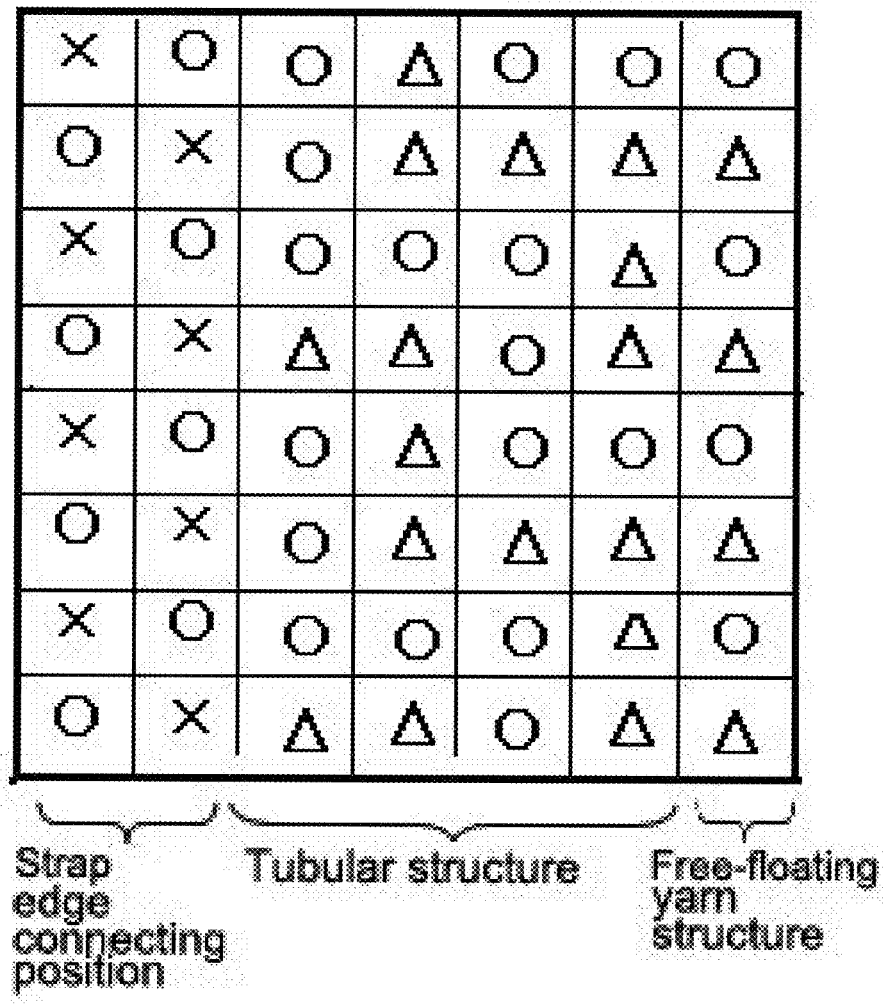
FIG. 13 is the weaving pattern of the first type segment (with internal free-floating yarns) of the fabric strap of FIG. 12.
Figure 14:
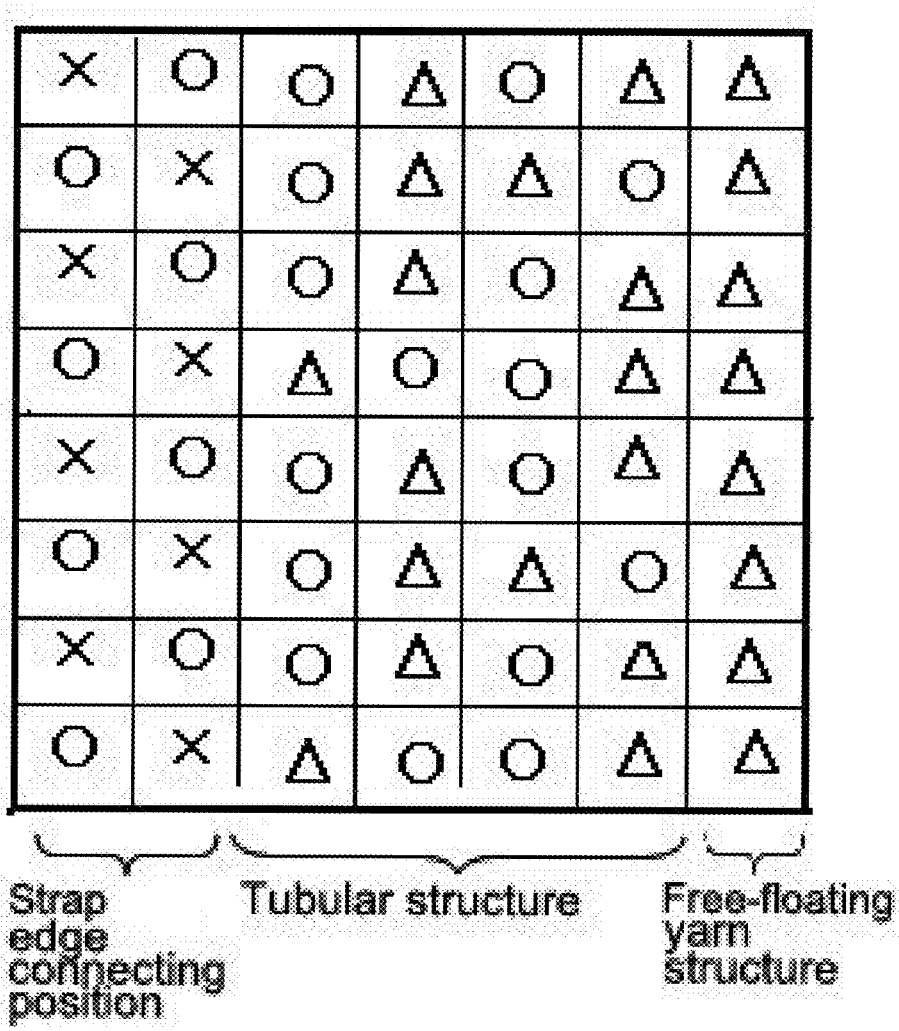
FIG. 14 is the weaving patterns of the second type segment (without internal free-floating yarns) of the fabric strap of FIG. 12.
Figure 15:
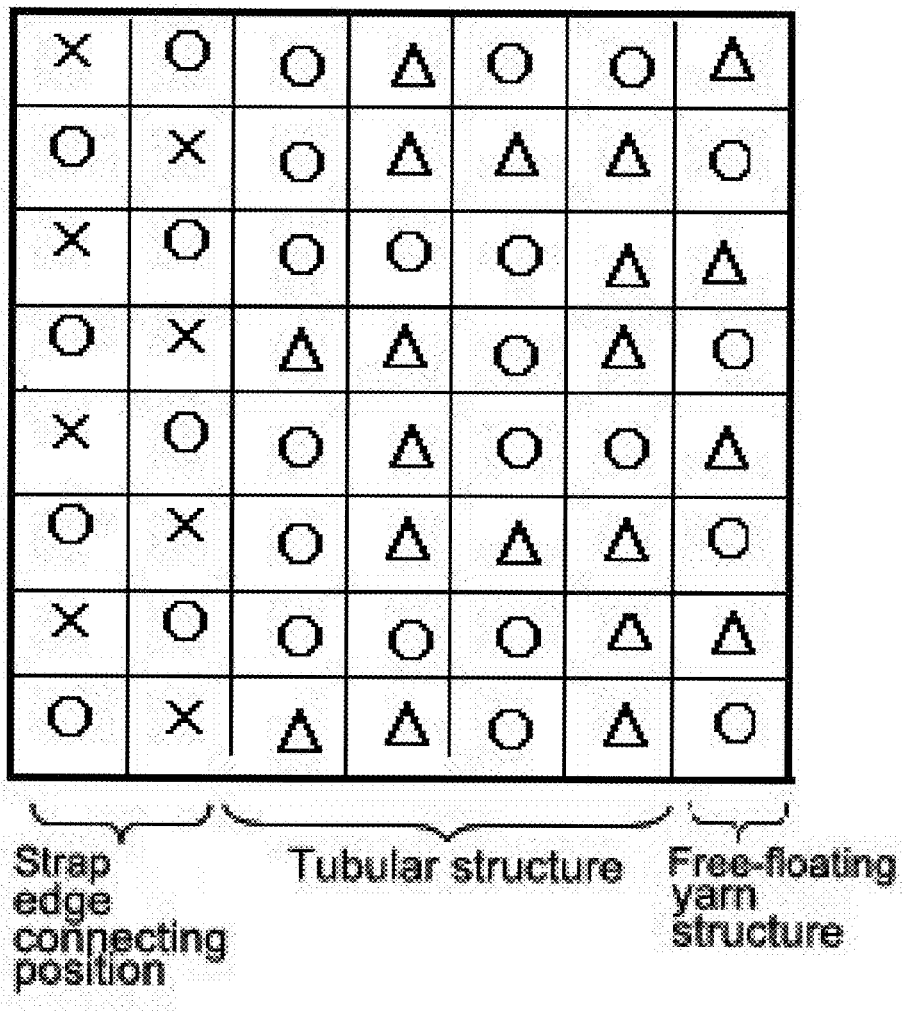
FIG. 15 is the weaving patterns at the intersection between the first type segment and the second type segment of the fabric strap of FIG. 12.

FIG. 12 shows another mode to carry out the invention, where 201 free-floating yarns, 210 are warp yarns and 214 are weft yarns. Instead of having a double-weft structure, the mode uses a single weft structure. In other words, there is no middle framework layer dividing the internal space of the tubular structure, which however is similarly filled with free-floating yarns. In terms of the fabricating process, one difference is the use of a single weft hook accessories. In terms of weaving patterns, the details are shown in FIGS. 13, 14 and 15 for the segment containing free-floating yarns (first type), the segment without free-floating yarns (second type), and the interface between the first type and second type segments, respectively. The mode for carrying out the invention is suitable in situations where a small quantity of wandering yarns is necessary. The advantage is that it has a simpler structure and is suitable for production automation.

There is still another mode of the present invention, which is based on all previously described embodiments of the present invention. In the previously described embodiments, the free-floating yarns are exposed to the outside of the strap at the intersection between the first type and second type segments and are then cut off therefrom. In this further variation, the free-floating yarns are not cut off but woven into the strap itself in the narrower second type segment. This mode is suitable where it does not require significant cushion effect and thus fewer free-floating yarns are necessary (for example, 20-60 yarns of 111/36/2 SD Nylon). An exemplary weaving pattern of this mode is presented in FIG. 16. Because the step of cutting off the exposed free-floating yarns is eliminated, it is conducive to production automation and significantly improves the production efficiency.

Figure 17:
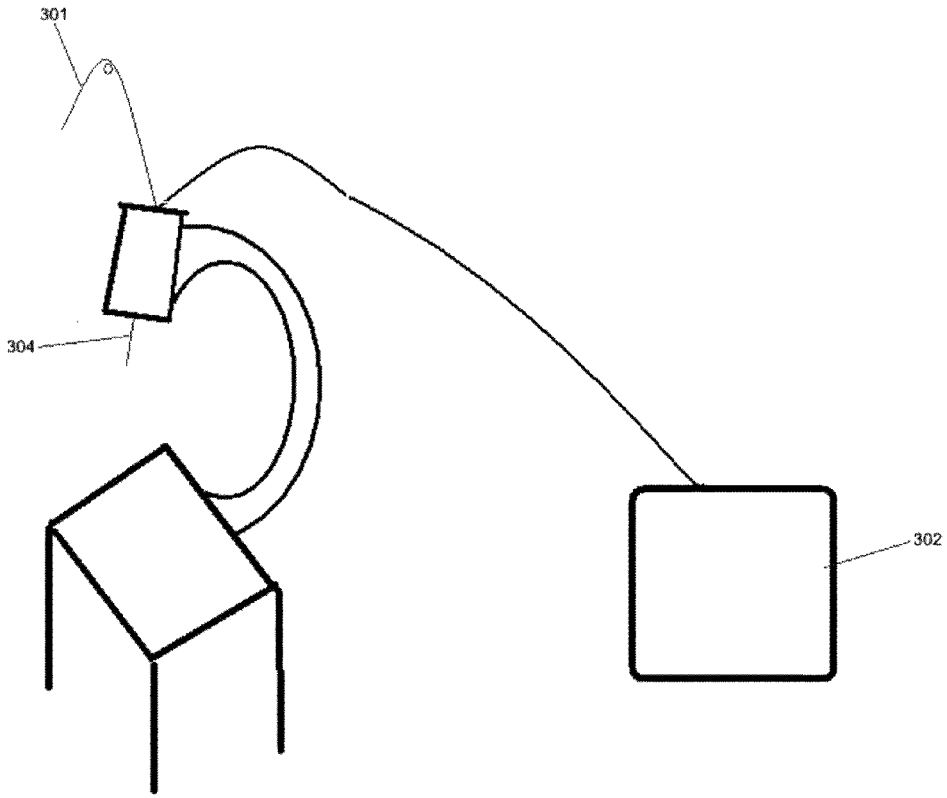
FIG. 17 shows a diagrammatic representation of a yarn-injecting machine.

As a further mode to carry out the present invention, the free-floating yarns are not integrally woven inside the strap. Instead, they are injected into the tubular structure at the second type segment of the strap using a yarn-injecting machine as shown in FIG. 17, where 301 is the yarn to be injected into the strap, 302 is an air-pressure pump and 304 is the needle which can insert into the internal space of the tubular structure of the strap. The advantage of this mode is the improvement in production efficiency because reduction of warp density (as integral free-floating yarns are not used) in the weaving process.

In summary, with a simple structure having integrally woven two different types of segments (one of which contains internally filled free-floating yarns), the fabric strap of the present invention is conducive to production automation and can be manufactured with high production efficiency compared to the existing technology. The fabric strap of the present invention may be used as underwear's shoulder straps, girdles and waist belts. Due to the presence of internally provided soft, thick and free-floating yarns at one segment, it feels comfortable when in contact with the skin. Furthermore, the other segments containing no free-floating yarns, which are thinner and narrower and tightly woven, are more esthetically pleasing.

While there have been described and pointed out fundamental novel features of the invention as applied to a preferred embodiment thereof, it will be understood that various omissions and substitutions and changes, in the form and details of the embodiments illustrated, may be made by those skilled in the art without departing from the spirit of the invention. The invention is not limited by the embodiments described above which are presented as examples only but can be modified in various ways within the scope of protection defined by the appended patent claims. It is further understood that the present invention is primarily in the idea itself, which can be practiced by people of ordinary skill in the art even without referring to the details of the foregoing specification. For example, selection of yarn materials and design of weaving patterns can be carried out by ordinarily skilled people in practicing the present invention.

What is claimed is:

1. A fabric strap, comprising a first segment and a second segment, and a plurality of longitudinally oriented yarns which are warps continuous from said first segment to said second segment or from said second segment to said first segment, said first segment having a wider width and a greater elasticity than said second segment, wherein said first segment is a tubular structure defining an internal space enclosed by an upper woven layer and lower woven layer and containing a plurality of free-floating yarns within said internal space, said internal space having two longitudinal ends, and said free-floating yarns each having two terminals which are, respectively, interwoven as warps with said upper woven layer and lower woven layer at said longitudinal ends of said internal space.

2. The fabric strap of claim 1, wherein said first segment comprises a middle woven layer dividing said internal space into two halves.

3. The fabric strap of claim 2, wherein both said halves of said internal space contain said free-floating yarns.

4. The fabric strap of claim 2, wherein only one of said halves contains said free-floating yarns.

5. A method of making a fabric strap having at least two different segments in an integral weaving process, comprising (a) a step of weaving a first segment that comprises an enclosed tubular structure with upper woven layer and lower woven layer and a plurality of free-floating yarns enclosed in said tubular structure, (b) a step of weaving a second segment which is non-tubular structure and comprises no free-floating yarns, and (c) a step of weaving an interface between said first segment and said second segment in which said free-floating yarns, said upper woven layer and lower woven layer of said first segment are integrally interwoven into a single layered structure, wherein said steps are continuous in the order of (a)-(c)-(b) or (b)-(c)-(a) in a single weaving process.

6. The method of claim 5, wherein said free-floating yarns are integrated as warps into the structure of said second segment.

7. The method of claim 6, wherein said free-floating yarns are exposed outside the structure of said second segment and being cut off therefrom.

8. The method of claim 5, wherein said first segment comprises a middle woven layer dividing said enclosed tubular structure into two halves.

9. The method of claim 8, wherein both of said two halves of said tubular structure of said first segment contain some of said free-floating yarns.

10. The method of claim 8, where only one of said two halves of said tubular structure of said first segment contains said free-floating yarns.

11. A method of making a fabric strap having at least two different segments in an integral weaving process, comprising (a) a step of weaving a first segment that comprises an enclosed tubular structure with upper woven layer and lower woven layer defining a sealed internal space, (b) a step of weaving a second segment which is non-tubular structure, (c) a step of weaving an interface between said first segment and said second segment in which said upper woven layer and lower woven layer of said first segment are integrally interwoven into a single layered structure, and (d) a step of injecting a soft free-floating material into said sealed internal space of said first segment using a yarn-injecting machine, wherein said steps are continuous in the order of (a)-(c)-(b) or (b)-(c)-(a) prior to performing step (d).

12. The method of claim 11, wherein said first segment comprises a middle woven layer dividing said sealed internal space into two halves.

13. The method of claim 12, wherein said soft free-floating material is injected into both of said two halves of said sealed internal space.

14. The method of claim 12, wherein said soft free-floating material is injected into only one of said two halves of said sealed internal space.

* * * * *

UNITED STATES PATENT AND TRADEMARK OFFICE

CERTIFICATE OF CORRECTION

PATENT NO. : 8,869,841 B2
APPLICATION NO. : 13/656765
DATED : October 28, 2014
INVENTOR(S) : Mike He It is certified that error appears in the above-identified patent and that said Letters Patent is hereby corrected as shown below:

On the Title Page add item (60),

Related U.S. Application Data

Provisional application No. 61/549,746, filed on Oct. 20, 2011.

Signed and Sealed this
Seventeenth Day of March, 2015

Michelle K. Lee

Michelle K. Lee
*Director of the United States Patent and Trademark Office*